US006238493B1

(12) United States Patent
Lin et al.

(10) Patent No.: US 6,238,493 B1
(45) Date of Patent: May 29, 2001

(54) METHOD OF MAKING A WEATHERING GRADE PLATE AND PRODUCT THEREFORM

(75) Inventors: Minfa Lin, Macungie; Richard L. Bodnar, Bethlehem, both of PA (US)

(73) Assignee: Bethlehem Steel Corporation, DE (US)

( * ) Notice: Subject to any disclaimer, the term of this patent is extended or adjusted under 35 U.S.C. 154(b) by 0 days.

(21) Appl. No.: 09/245,318

(22) Filed: Feb. 5, 1999

(51) Int. Cl.[7] ..... C22C 38/20; C22C 38/22; C22C 38/42; C21D 8/02

(52) U.S. Cl. ..... 148/335; 148/654; 420/104; 420/105; 420/109

(58) Field of Search ..... 148/335, 654, 148/661; 420/104, 105, 109, 110, 112

(56) References Cited

U.S. PATENT DOCUMENTS

| | | | | |
|---|---|---|---|---|
| 5,514,227 | | 5/1996 | Bodnar et al. . | |
| 5,634,988 | | 6/1997 | Kurebayashi et al. . | |
| 6,056,833 | * | 5/2000 | Asfahani et al. | 148/335 |

FOREIGN PATENT DOCUMENTS

| | | | | |
|---|---|---|---|---|
| 403064414 | * | 3/1989 | (JP) | 148/654 |

OTHER PUBLICATIONS

Standard Specification for Carbon and High–Strength Low–Alloy Structural Steel Shapes, Plates, and Bars and Quenched–and–Tempered Alloy Structural Steel Plates for Bridges (ASTM Designation: A709/A 709M—96).

Standard Specification for High–Strength Low–Alloy Structural Steel with 50 ksi [345 MPa] Minimum Yield Point to 4 in. [100 mm] Thick (ASTM Designation: A 588/A588M—94).

Standard Specification for High–Strength Low–Alloy Structural Steel Plate With Atmospheric Corrosion Resistance (ASTM Designation: A 871/A 871M—95).

Standard Specification for Quenched and Tempered Low–Alloy Structural Steel Plate with 70 ksi [485 MPa] Minimum Yield Strength to 4 in. [100 mm] Thick (ASTM Designation: A 852/A 852M—94).

Material Development for High–Performance Bridge Steels, (1995, J.M. Chilton and S.J. Manganello, Hot–Rolled Products Division, U.S. Steel Technical Center, Monroeville, PA 15146).

* cited by examiner

*Primary Examiner*—Deborah Yee

(57) ABSTRACT

A method of making a weathering grade steel plate includes the steps of casting, hot rolling, and accelerated cooling using a modified weathering grade alloy composition. The composition employs effective levels of manganese, carbon, niobium, molybdenum, nitrogen, and titanium. After the casting, the slab or ingot is heated and rough rolled to an intermediate gauge plate. The intermediate gauge plate is controlled finish temperature rolled and subjected to accelerated cooling. With the controlled alloy chemistry, rolling and cooling, the final gauge plate exhibits continuous yielding and can be used for applications requiring a 70 KSI minimum yield strength, a 90–110 KSI tensile strength, and a Charpy V-notch toughness greater than 35 ft-lbs. at −10° F. in plates up to 4.0" thick.

29 Claims, 3 Drawing Sheets

METHOD OF MAKING A WEATHERING GRADE PLATE AND PRODUCT THEREFORM

FIELD OF THE INVENTION

The present invention is directed to a method of making a weathering grade steel plate and a product therefrom and, in particular, to a method using a controlled alloy chemistry and controlled rolling and cooling conditions to produce an as-rolled and accelerated cooled weathering grade steel plate up to 4.0 inches in thickness and having a minimum 70 KSI yield strength, a tensile strength of 90–110 KSI, and a Charpy V-notch toughness greater than 35 ft-lbs at −10° F.

BACKGROUND ART

In the prior art, lower carbon, high strength (or High Performance Steel, HPS) weathering grade steels are being increasingly employed for bridge, pole and other high strength applications. These steel materials offer three advantages over concrete and other types of steel materials. First, the use of higher strength materials can reduce the overall weight of the structure being built and can also reduce the material cost. Consequently, designs using these weathering grade steels can be more competitive with concrete and those designs employing lower strength steels. Second, the weathering grade or atmosphere corrosion-resistant grade steel can significantly reduce the maintenance cost of structures such as bridges or poles by eliminating the need for painting. These weathering grad e steels are particularly desirable in applications which are difficult to regularly maintain, for example, bridges or poles located in remote areas. Third, lower carbon (i.e., 0.1% carbon maximum) and lower carbon equivalent levels improve the weldability and toughness of the steel.

The use of th ese types of steels is guided by ASTM specifications. One ASTM specification for a weathering grade steel which is commonly used for bridge applications includes A709-Grades 70W and HPS 70W. The bridge-building, 70W grades require a 70 KSI minimum in yield strength. This specification also requires that these grades be produced by rolling, austenitizing, quenching, and tempering. The conventional 70W grade is a higher carbon grade (0.12% by weight), whereas the newer HPS 70W grade utilizes a lower carbon level (0.10% by weight). The HPS 70W grade is generally produced in plates up to 3.0" in thickness. Table 1 lists the ASTM specifications with Table 2 detailing the mechanical property requirements for the various specifications. Table 3 details the compositional requirements for these specifications. The disclosure of ASTM specification number A709 for all grades is hereby incorporated by reference. As noted above, the higher strength specifications require a hot rolled, austenitized, quenched, and tempered processing. Moreover, the tensile strength is specified as a range, i.e., 90–110 KSI, rather than a minimum which is used in other specifications, see for example, A871-Grade 65 that specifies a tensile strength greater than or equal to 80 KSI.

ASTM weathering grade plate specifications are not without their disadvantages. First, processing whereby the hot rolled product must be reheated, quenched and tempered is energy intensive. Second, these quenched and tempered grades are limited by plate length due to furnace length restrictions. In other words, only certain length plates can be heat treated following the quenching operation since the furnaces will accept only a set length, in some instances, only up to 600". Bridge builders particularly are demanding ever-increasing lengths (to reduce the number of splicing welds required and save fabrication cost) of plate for construction, such demands are not being met by current plate manufacturing technology for high strength steels.

Many bridge manufacturers are also requiring thicker plates for more-demanding applications. Present day prior art grades do not always offer a cost-effective solution when thick plates, e.g., greater than 2" or even as thick as 3" are desired.

Third, the high strength ASTM specifications requiring a minimum of 70 KSI yield strength also poses a difficulty in manufacturing by specifying a lower and an upper limit for tensile strength, i.e., 90–110 KSI for A709-Grade 70W. More particularly, one cannot merely target a minimum 70 KSI yield strength to meet the A709 specification since too high of a yield strength may also result in a tensile strength above the 110 KSI maximum.

In view of the disadvantages associated with current weathering grade steel specifications, a need has developed to produce plates in ever-increasing lengths and in a more cost-effective manner (lower production costs and quicker delivery). In addition, a need has developed to provide an as-rolled and cooled plate product having a greater thickness than presently available.

In response to the above-listed needs, the present invention provides a method of making a weathering grade steel plate and a product therefrom. More particularly, the inventive method uses a controlled alloy chemistry, a controlled rolling, and a controlled cooling to produce an as-rolled and cooled weathering grade steel plate which meets ASTM specification requiring a minimum of 70 KSI yield strength, a 90–110 KSI tensile strength, and good toughness when measured by Charpy V-notch impact energy testing. The inventive method combines controlled rolling and accelerated cooling with the controlled alloy chemistry to meet the ASTM specifications for 70 KSI minimum yield strengths, tensile strength of 90–110 KSI, toughness values of greater than 35 ft-lbs. at −10° F., and plate up to 4.0" thick. The processing is more energy efficient since no re-austenitizing and tempering are required. Further, plates as thick as 3.0 to 4.0" can be manufactured while still meeting specification requirements.

The use of accelerated cooling and hot rolling is disclosed in U.S. Pat. No. 5,514,227 to Bodnar et al. (herein incorporated in its entirety by reference). This patent describes a method of making a steel to meet ASTM A572, Grade 50, a 50 KSI minimum yield strength specification. The alloy chemistry in this patent specifies low levels of vanadium and 1.0 to 1.25% manganese. Bodnar et al. is not directed to weathering grade steels nor methods of making plate products requiring either a yield strength in the range of 70 KSI, a tensile strength of 90–110 KSI, or a toughness value as stated above.

SUMMARY OF THE INVENTION

Accordingly, it is a first object of the present invention to provide an improved method of making a weathering grade steel plate.

Another object of the present invention is a method of making a weathering grade steel plate that meets ASTM specifications for bridge building in terms of yield and tensile strength requirements, toughness, and plate thickness.

A still further object of the present invention is a method of making a weathering grade steel plate having excellent toughness, castability, formability, and weldability.

Another object of the present invention is a weathering grade steel plate employing a controlled alloy chemistry and controlled rolling and cooling parameters to meet ASTM specifications.

A further object of the invention is a method of making a weathering grade steel plate product in an as-rolled and accelerated cooled condition, making it economically superior and having a shorter delivery time with respect to quenched and tempered weathering grade plates.

Yet another object is a method of making lengths of weathering grade steel plate which are not limited by either austenitizing or tempering furnace dimensional constraints and which can be up to 4.0" in thickness.

Other objects and advantages of the present invention will become apparent as a description thereof proceeds.

In satisfaction of the foregoing objects and advantages, the present invention provides a method of making an as-rolled and cooled weathering grade steel plate having a minimum of 70 KSI yield strength, 90–110 KSI tensile strength and a Charpy V-notch toughness greater than 35 ft-lbs. at −10° F. A heated shape is provided that consists essentially of, in weight percent:

from about 0.05% to about 0.12% carbon;
from about 1.00% to about 1.80% manganese;
up to about 0.035% phosphorus;
up to about 0.040% sulfur;
from about 0.15% to about 0.65% silicon;
from about 0.20% to about 0.40% copper;
an amount of nickel up to about 0.50%;
from about 0.40% to about 0.70% chromium;
from about 0.05% to about 0.30% molybdenum;
from about 0.03% to about 0.09% niobium;
from about 0.005% to about 0.02% titanium;
an amount of aluminum up to 0.10%;
from about 0.001% to about 0.015% nitrogen;
with the balance iron and incidental impurities.

The cast shape, e.g., ingot or slab, is heated and rough rolled above the recrystallization stop temperature of austenite (i.e., $T_r$) to an intermediate gauge plate. The intermediate gauge plate is finish rolled beginning at an intermediate temperature below the $T_r$ (i.e., in the austenite non-recrystallization region) to a finish rolling temperature above the $Ar_3$ temperature to produce a final gauge plate. The final gauge plate can be up to 4.0" thick, depending on the plate application. The preferred plate thickness range falls between about 0.5" to up to 4.0", and more preferably, between 0.5" and 3.0" thick.

The final gauge plate is either liquid and/or air/water mixture media accelerated cooled to achieve the desired mechanical and physical properties. When accelerated cooled, the start cooling temperature is above the $Ar_3$ temperature to ensure uniform mechanical properties throughout the entire plate length. The plates are accelerated cooled until the finishing cooling temperature is below the $Ar_3$ temperature. Accelerated cooling is that cooling, using water, an air/water mixture, a combination thereof, or another quenchant, which rapidly cools the hot worked final gauge plate product to a temperature below the $Ar_3$ temperature to produce a fine grained microstructure plate product with good toughness and high strength. As will be shown below, the start and stop cooling temperatures for the accelerated cooling are important in controlling the yield strength, tensile strength, and toughness.

The alloy chemistry has preferred embodiments to optimize the plate mechanical properties in conjunction with a given plate thickness. For example, the carbon content of the preferred alloy falls within a range from about 0.07 to 0.09% by weight. The manganese can range between about 1.10% and 1.70%, more preferably between about 1.20% and 1.40%. The niobium ranges between about 0.04% and 0.08%, more preferably between about 0.05% and 0.07%. The molybdenum ranges between about 0.05% and 0.15%, more preferably between about 0.08% and 0.012%. The titanium ranges between about 0.005% and 0.02%, more preferably between about 0.008% and 0.014%. Nitrogen can range between about 0.006% and 0.008%.

When accelerated cooling is used, the heated slab chemistry and the accelerated cooling contribute to a continuous yielding effect in the cooled final gauge plate. A preferred cooling rate for the accelerated cooling step ranges between about 5 and 50° F./second for plate thickness ranging from 0.5 inches to up to 4.0 inches, more particularly between 5 and 25° F./second for plates ranging between 0.75 inches and 3.0 inches in thickness.

During accelerated cooling, the start cooling temperature preferably ranges from about 1350° F. to about 1600° F., more preferably from about 1400° F. to about 1515° F. The finish cooling temperature ranges between about 850° F. and 1300° F., more preferably, between about 900° F. and 1050° F.

The invention also includes a plate made by the inventive method as an as-rolled and cooled weathering grade steel plate, not a quenched and tempered plate product. The plate can have a plate thickness of up to 4.0 inches, a minimum of 70 KSI yield strength, and a 90–110 KSI tensile strength. The plate also has a Charpy V-notch toughness greater than 35 ft-lbs. at −10° F. The alloy chemistry or composition is also part of the invention, in terms of its broad and preferred ranges.

BRIEF DESCRIPTION OF THE DRAWINGS

Reference is now made to the drawings of the invention wherein.

DESCRIPTION OF THE PREFERRED EMBODIMENTS

Figure 1:
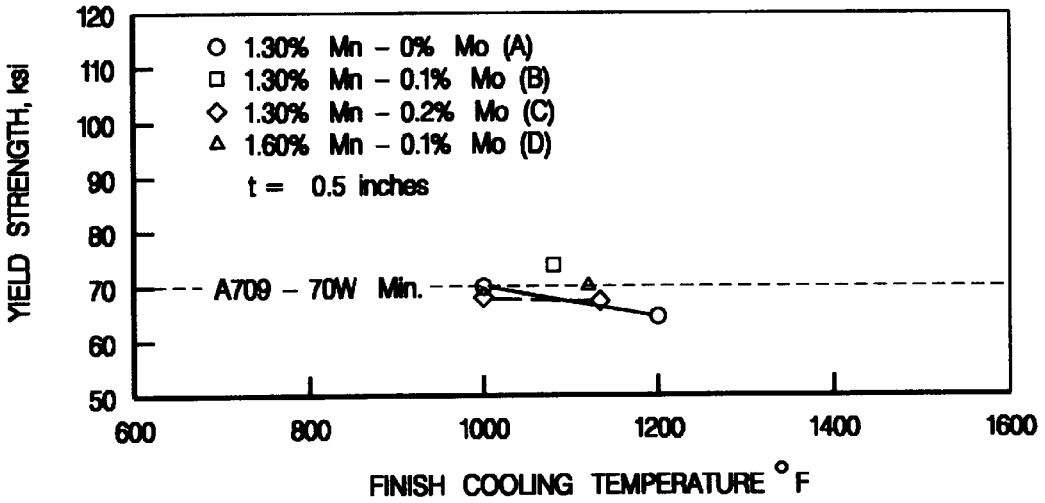
FIG. 1 is a graph based on laboratory-derived data that depicts the effects of manganese and molybdenum and finish cooling temperature on yield strength for 0.5" plates.

The present invention provides a significant advancement in producing weathering grade steel plate in terms of cost-effectiveness, improved mill productivity, flexibility, improved formability, castability, and weldability, and energy efficiency. The inventive method produces a weathering grade steel plate in an as-rolled and accelerated cooled condition, thereby eliminating the need for quenching and tempering as is used in present day weathering grade steel plates. With the inventive processing, the chemical and mechanical requirements for ASTM specifications requiring a minimum of 70 KSI yield strength, and a tensile strength of 90–110 KSI can be met. Weathering grade is intended to mean alloy chemistries as exemplified by the above-referenced ASTM specification that employ effective levels of copper, nickel, chromium and silicon to achieve atmospheric corrosion resistance whereby the steel can be used bare in some applications.

In addition, the length of the as-produced plate is not limited to lengths required to fit existing austenitizing or tempering furnaces. Thus, lengths in excess of 600" or more can be made to meet specific applications, e.g., bridge building and utility pole use. Thus, longer plates can be used in bridge building fabrication, thereby reducing the number of splicing welds. Further, plates up to about 4.0" in thickness can be manufactured within the required 70 KSI minimum yield strength and 90–110 KSI tensile strength ASTM specification.

The inventive method links the minimum yield strength, tensile strength range, and toughness requirements of the A709 specification to controlled alloy chemistry, controlled rolling and controlled accelerated cooling. Initially, a heated shape such as a slab or ingot is first cast (batch or continuous) with a controlled alloy chemistry. Subsequently, the slab/ingot is controlled hot rolled. Following controlled hot rolling, the final gauge rolled plate product is subjected to accelerated cooling under controlled conditions to achieve a target minimum yield strength and tensile strength range, plate thickness, and toughness as measured by Charpy V-notch testing.

The plate thickness can range up to 4" for a minimum 70 KSI yield strength and a tensile strength of 90–110 KSI, generally ranging from about 0.5" to up to 3.0". The ability to make an as-rolled and cooled plate (not quenched and tempered) having a thickness of 4.0" is a significant advancement over prior art techniques that make weathering grade 70 KSI minimum yield strength plate product.

The alloy chemistry includes the alloying elements of carbon, manganese, and effective amounts of silicon, copper, nickel, and chromium. These latter four elements contribute to the weathering or atmospheric corrosion resistant properties of as-rolled and cooled plate. With these elements, the as-rolled and cooled plate has a minimum Corrosion Index of at least 6.0, preferably at least 6.7, per ASTM G101, the Guide for Estimating the Atmospheric Corrosion Resistance of Low-Alloy Steels, herein incorporated by reference.

Microalloying elements of titanium, molybdenum, and niobium are also used along with an effective amount of nitrogen. The balance of the new plate chemistry is iron, basic steelmaking alloying elements (such as aluminum) and incidental impurities (such as sulfur and phosphorus) commonly found in steel compositions.

The carbon is controlled to a low level, that which is below the peritectic cracking sensitive region to improve castability, weldability, and formability.

The presence of titanium introduces fine titanium nitride particles to restrict austenite grain growth during reheating and after each rolling pass during the controlled rolling sequence. The presence of niobium carbonitrides retards austenite recrystallization during rolling and provides precipitation strengthening in the as-cooled microstructure. The molybdenum generally contributes to increases in yield strength and tensile strength (increased austenite hardenability) while reducing tensile ductility. Molybdenum may also enhance the corrosion or weathering resistant properties of the steel. Manganese generally contributes to improved strength. Increasing amounts of molybdenum and manganese contribute to increases in the amounts of bainite and martensite in the rolled plate microstructure.

It should also be understood that the alloy chemistry contributes to continuous yielding in the as-rolled and cooled plate as opposed to discontinuous yielding. Discontinuous yielding is marked by the presence of a yield drop in an engineering stress-strain diagram. More particularly, in these types of materials, elastic deformation occurs rapidly until a definitive yield drop is reached. At the yield point, a discontinuity occurs whereby stress does not continuously increase with respect to applied strain. Beyond the yield point, a continued increase in stress/strain causes further plastic deformation. Continuous yielding, on the other hand, is marked by the absence of a distinct yield point, thus showing a continuous transition from elastic to plastic deformation. Depending on steel chemistry and microstructure, the onset of plastic deformation can be earlier (lower yield strength) or similar to that of the similar steel which exhibits discontinuous yielding.

Yield strength is often measured at a 0.2% offset to account for the discontinuous yielding phenomena or the yield point in many materials. Using a 0.2% offset to measure yield strength may result in a somewhat lower yield strength value for materials that exhibit continuous yielding behavior, for example, when the onset of plastic deformation occurs at a low strength. However, tailoring the alloy chemistry, in combination with controlled rolling and accelerated cooling, produces a continuous yielding plate that meets minimum ASTM yield strength, tensile strength, and toughness requirements for 70 KSI weathering grade plate steel.

Once the target plate thickness is established, the alloy is cast into an ingot or a slab for subsequent hot deformation. In the preferred embodiment, the plate steel is continuously cast in order to better achieve the benefits of titanium nitride technology. For example, in continuously cast slabs, titanium nitride particles are dispersed throughout the steel product being manufactured. Such dispersed nitride particles restrict grain growth in the steel during both the reheating and cooling of the steel, and after each austenite recrystallization during roughing passes. Since such casting techniques are well known in the art, a further description thereof is not deemed necessary for understanding of the invention. After casting, the cast slab is reheated between about 2000° F. and 2400° F., preferably around 2300° F., and subjected to a controlled hot rolling. A first step in the hot rolling process is a rough rolling of the slab above the recrystallization stop temperature (generally being around 1 800° F.). This temperature is recognized in the art and a further description is not deemed necessary for understanding of the invention. During this rough rolling, the coarse grains of the as-cast slab are refined by austenite recrystallization for each rolling pass. The level of reduction can vary depending on the final gauge plate target and the thickness of the as-cast slab. For example, when casting a 10" slab, the slab may be rough rolled to a thickness ranging from 1.5" to 7" during the rough rolling step. As explained more fully below, for thicker plate, the reduction percentage from slab/ingot to the intermediate gauge plate and from the intermediate gauge plate to the final gauge plate should be sufficiently high to achieve adequate toughness in the final gauge plate. More particularly, the rolling reduction should cause enough grain refinement through austenite recrystallization during rough rolling and austenite grain flattening, as described below, during the finish rolling step so that the final gauge plate microstructure has a sufficiently fine grain size to meet the ASTM specification toughness minimums.

This intermediate or transfer gauge plate is then controlled finished rolled as described below. The intermediate gauge plate is finished rolled at a temperature below the recrystallization stop temperature but above the austenite-to-ferrite transformation start temperature ($Ar_3$) to reach the final gauge. The level of reduction in this rolling sequence may also vary but ranges from about 50 to 70% reduction, preferably 60–70%, from the intermediate gauge to the final gauge plate. During this finish rolling step, the grains are flattened to enhance grain refinement in the finally cooled product.

Once the finish rolling step is completed, the final gauge plate is subjected to accelerated cooling to achieve the minimum yield strength of 70 KSI, a tensile strength within the required range of 90–110 KSI, and minimum toughness for the final gauge plate.

The controlled finish rolling is preferably performed under moderate conditions. That is, the finish rolling temperature is targeted at above the $Ar_3$ temperature to achieve both a very fine grain structure in the final gauge plate product and improved mill productivity. By finishing the rolling at a temperature significantly higher than the $Ar_3$ temperature, the rolling requires a shorter total time, thereby increasing mill productivity. The finish rolling temperature can range from about 1400° F. to 1650° F., preferably 1450° F. to 1600° F. Rolling above the $Ar_3$ temperature also avoids hot working a ferritic structure, resulting in a non-uniform grain structure in the final gauge plate.

As mentioned above, rolling is completed above the $Ar_3$ temperature and the start of cooling should commence above this limit as well. Preferred ranges for the start cooling temperature range between about 1350° F. and 1600° F., more preferably between about 1400° F. and 1600° F., depending on the actual $Ar_3$ temperature of each steel chemistry. The finish cooling temperature should be sufficiently high to avoid formation of undesirable microstructures such as too much martensite and/or bainite. A preferred range for the finish cooling temperature is between about 850° F. and 1300° F., more preferably, between about 900° F. and 1050° F.

The broad and more preferred weight percentage ranges and limits for the various alloying elements are defined in weight percent as follows:

carbon 0.05–0.12%, preferably 0.07–0.10%, more preferably 0.075–0.085% with an aim of 0.08%;

manganese 1.00–1.80%, preferably 1.10–1.70%, more preferably 1.20–1.40%, most preferably 1.25–1.35%, with an aim of 1.30%;

up to about 0.035% phosphorus, preferably up to about 0.015%;

up to about 0.040% sulfur, preferably up to about 0.005%;

from about 0.15% to about 0.65% silicon;

from about 0.20% to about 0.40% copper;

from about 0.40% to about 0.70% chromium;

an amount of nickel up to about 0.50%, preferably between about 0.20% and 0.40%;

molybdenum, 0.05–0.30%, preferably 0.08–0.30%, more preferably 0.10–0.15%, with an aim of 0.12%;

niobium 0.03–0.09%, preferably 0.04–0.08%, more preferably 0.055–0.07%, with an aim of 0.060%;

titanium 0.005–0.02%, preferably 0.01–0.015%, with an aim of 0.012%;

an amount of nitrogen up to 0.015%; preferably 0.001–0.008%, more preferably 0.006–0.008%, an amount of aluminum up to 0.1%, generally in an amount to fully kill the steel during processing, preferably between about 0.02% and 0.06%; and the balance iron and incidental impurities.

A preferred target chemistry is about 0.07–0.09% C, 1.25–1.35% Mn, 0.35–0.45% Si, 0.25–0.35% Cu, 0.25–0.35% Ni, 0.45–0.55% Cr, 0.055–0.065% Nb, 0.09–0.11% Mo, 0.008–0.014% Ti, 0.006–0.008% N, 0.02 to 0.045% Al, with the balance iron and incidental impurities, with aims of 0.08% C, 1.30% Mn, 0.4% Si, 0.3% Cu, 0.3% Ni, 0.5% Cr, 0.060% Nb, 0.10% Mo, 0.012% Ti, 0.007% N, with the balance iron and incidental impurities.

Other alloying elements in levels that cause the plate product to deviate from the target mechanical and physical properties are neither desired nor needed since the alloy chemistry defined above produces a plate product meeting the ASTM 70 KSI weathering grade specifications.

The steel may be either in a fully killed state or semi-killed state when processed, but is preferably fully killed. Since "killing" of steel along with the addition of conventional killing elements, e.g., aluminum, is well recognized in the art, no further description is deemed necessary for this aspect of the invention.

Experimental trials were conducted in a laboratory investigating the various aspects of the invention. The following details the procedures and results associated with the laboratory trials. It should be understood that the actual trials conducted are intended to be exemplary in terms of the various processing and compositional parameters used in conjunction with the invention. Such trials are not to be interpreted as limiting the scope of the invention as defined by the appended claims. Percentages unless otherwise stated are in weight percent. Metric conversion for the experimental values can be made using the factors: 1 KSI=6.92 MPa, 1 KSI=1.43 kg/mm$^2$, ° C.=5/9(° F.−32), and 1"=25.4 mm.

LABORATORY TRIALS PROCEDURES

Four experimental compositions with different manganese and molybdenum levels (1.30% Mn—0.0% Mo, 1.30% Mn—0.1% Mo, 1.30% Mn—0.2% Mo, and 1.60% Mn—0.1% Mo) were melted in a vacuum-induction furnace and cast as 500-lb. ingots measuring about 8.5" square by 20" long. The product analyses for each heat are listed in Table 4. Each of the ingots was first soaked at 2300° F. for three hours, and hot rolled to 6" thick by 5" wide billets. Small 5" length pieces were cut from each billet, reheated to 2300° F. and control rolled to 1.5", 2.0" and 3.0" thick plates. Thinner billets of 4" in thickness were also prepared from some of the ingots and rolled to 0.5" and 1.0" plates. Prior to rolling, a thermocouple was inserted into a 1.5" deep hole drilled into the side of each block at the mid-thickness location to permit temperature measurement/control during rolling and accelerated cooling. The range of rolling and cooling parameters investigated for all the plates produced by accelerated cooling processing are shown in Table 5. The rolling practices are described as intermediate temperature, finish rolling temperature, and percent reduction from intermediate gauge to final gauge, each value separated by front slashes. Finish cooling temperature is abbreviated as FCT. Table 6 details the mechanical test results associated with Alloys A–D as processed according to the practices detailed in Table 4.

A laboratory apparatus was used to simulate production accelerated cooled processing. The apparatus includes a pneumatic-driven quenching rack and a cooling tank filled with 1 to 4% (by volume) Aqua Quench 110, a polymer quenchant, and water. After the last pass of finish rolling, the plate is moved onto the rack, cooled in air for about 20 seconds, and then quenched on a cooling table inside the tank. The plate mid-thickness temperature is continuously monitored by an embedded thermocouple, and when the temperature reaches the desired finish cooling temperature (FCT), the plate is removed from the solution and cooled in air.

Additional trials were also conducted on alloy chemistries employing varying amounts of carbon, boron, and molybdenum. These trials are not described in detail since the trial results indicated that such chemistries were not appropriate to solve the problems in the prior art as discussed above. For the 0.5" plates, duplicate transverse, full thickness, flat threaded specimens were removed and tested. Two longitudinal, full-size Charpy V-notch (CVN) specimens were removed from each 0.5" plate as near as possible to the quarter thickness location. For the thicker plates (t>1"), duplicate transverse 0.505" diameter tensile and duplicate longitudinal full-size CVN specimens were machined form the quarter thickness location. The testing temperatures for the CVN specimens was at −10° F. For metallographic examination, small full-thickness specimens were removed from each plate and polished on a longitudinal face, etched in 4% picral and 2% nital solutions, and examined in a light microscope. Representative photomicrographs were taken at a magnification of 200× for each plate at the mid-thickness location. In the accelerated cooled condition, all steel plates evaluated in this study exhibited continuous yielding behavior in their stress-strain curves.

LABORATORY TRIAL RESULTS

As noted above, investigative trials were conducted on steels containing varying amounts of boron, carbon, and molybdenum in an effort to make a plate product in an as-cast, rolled, and cooled condition to meet the 70 KSI weathering grade specifications for ASTM. In brief, these investigative trials revealed that a first group of steels employing 0.10% carbon had excessively high tensile strength and poor CVN toughness, the tensile strength outside the range of 90–110 KSI for the A709 70W grade.

A further trial was conducted whereby the carbon content was lowered from 0.10% to 0.06%. In this study, although the lowered carbon content resulted in a somewhat lowered tensile strength, the Charpy impact toughness for these lowered carbon- and boron-containing steels was still poor, thus making them unacceptable candidates as a target chemistry for making weathering grade steel plates meeting the ASTM A709-70W requirements. Since these trials were not successful in making a plate product to meet the target ASTM specification, a full discussion thereof is not included as part of the description of the invention.

In contrast to the ineffective carbon- and boron-containing steel chemistries, trials using an alloy chemistry containing effective amounts of manganese, molybdenum, niobium, and titanium did result in the manufacture of plates ranging from 0.5 to up to 3 inches in thickness. These plates had the requisite strength and/or toughness requirements for the weathering grade A709-70W specification. Results of the trials using this alloy chemistry and various rolling and cooling conditions are summarized in Table 6 and discussed below by plate thickness.

0.5 INCH THICK PLATES

Referring to FIG. 1, the effect of finish cooling temperature on yield strength for the alloy compositions described in Table 3, Alloys A–D, for 0.5 inch plates is depicted. The 0.5 inch plates were rolled using the practice of 780° F./1550° F./75% (intermediate gauge temperature, finish rolling temperature, and rolling percent reduction after intermediate gauge). As can be seen from this figure, too high of a finish cooling temperature results in a plate product with an insufficient yield strength, i.e., less than the minimum 70 KSI yield strength. All four steels did exhibit excellent CVN toughness and tensile strength within the range of 90–110 KSI (Table 6), but only the 1.30% Mn—0.1% Mo steel (Alloy B) met the 70 KSI yield strength minimum.

FIG. 1 also illustrates the effect of molybdenum. That is, when molybdenum is increased, yield strength is increased, due to the increased austenite hardenability provided by the molybdenum.

Comparing the two steels having 0.1% molybdenum and different levels of manganese, the yield strength of the steel decreased somewhat but the tensile strength increased by about 5 KSI. The molybdenum and manganese contents also affected microstructure. More particularly, increasing levels of molybdenum and manganese tend to increase the amount of bainite and/or martensite in the microstructure of the final gauge plate.

The trials using a plate thickness of 0.5 inches indicate that for finish cooling temperatures in the range of 1000–1200° F., only one of the steels has the strength and toughness balance to meet A709–70W requirements. However, it is believed that the other three steels can meet the requirements if the finish cooling temperature is lowered to less than about 1000° F., more preferably between 900 and 1000° F., most preferably around 900° F.

1.0 INCH THICK PLATES

Figure 2A:
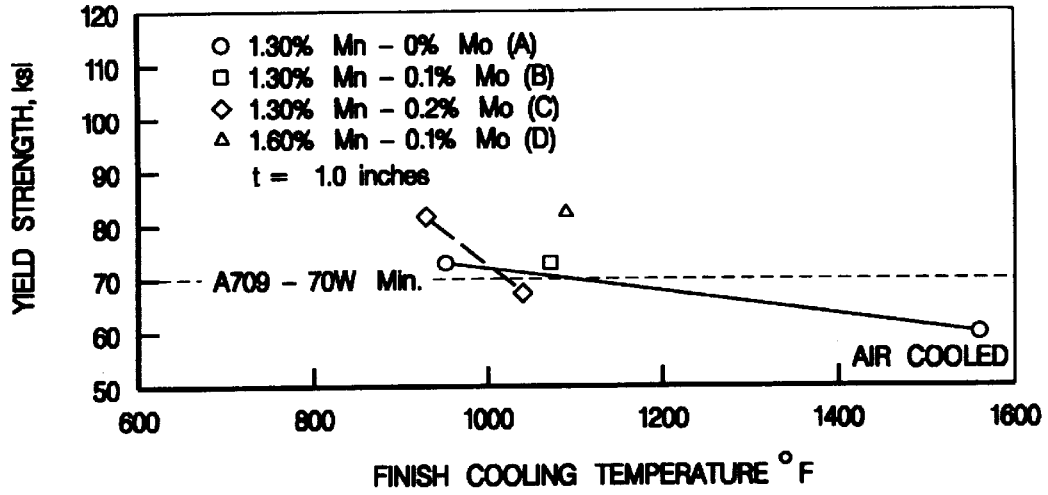
FIGS. 2A and 2B are graphs based on laboratory-derived data that depict the effects of manganese and molybdenum, air cooling, and finish cooling temperatures on yield strength and tensile strength for 1.0" plates.
Figure 2B:
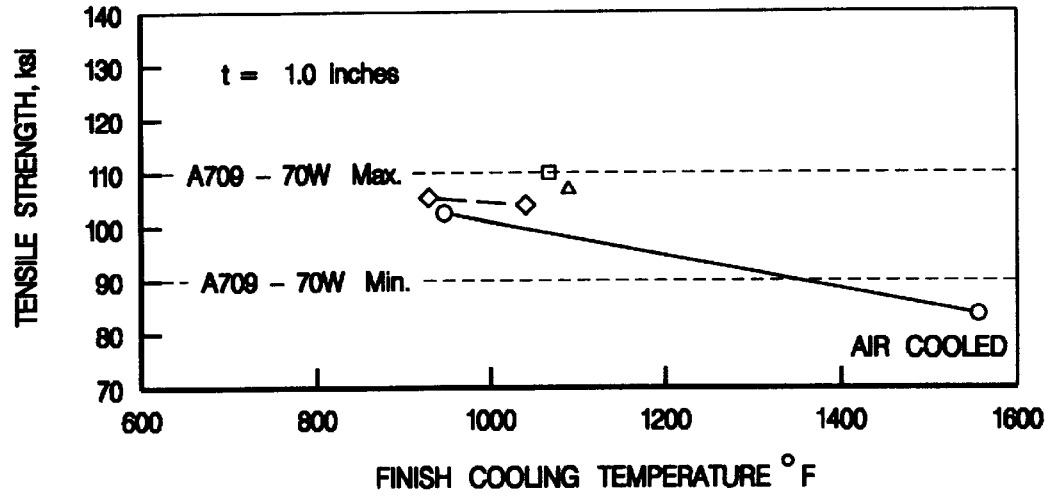

Referring to FIGS. 2A and 2B, finish cooling temperature is plotted versus yield strength and tensile strength for the steels having the varying manganese and molybdenum contents. These figures indicate that the air cooled plates do not meet the minimum yield strength or tensile strength for the A709-70W ASTM specifications.

The 1" thick plates were rolled with a practice of 1780° F./1550° F./60%. As can be seen from FIGS. 2A and 2B, an excellent yield and tensile strength balance is achieved to meet the A709-70W requirements when accelerated cooling to a FCT between 900–1100° F. is employed. It should be noted that, as in the case with the 0.5" plates, the Alloy C with 0.2% molybdenum had an insufficient yield strength when the FCT was above 1000° F. As shown in Table 6, all four of Alloys A–D exhibit excellent CVN toughness at −10° F.

The effect of molybdenum and manganese on the mechanical properties and microstructures for the 1.0" plates is similar to that described for the 0.5" plates.

In summary, all four of Alloys A–D met the A709-70W mechanical property requirements when accelerated cooled at about 15° F./second to an FCT between 900 and 1100° F.

1.5 INCH THICK PLATES

Figure 3A:
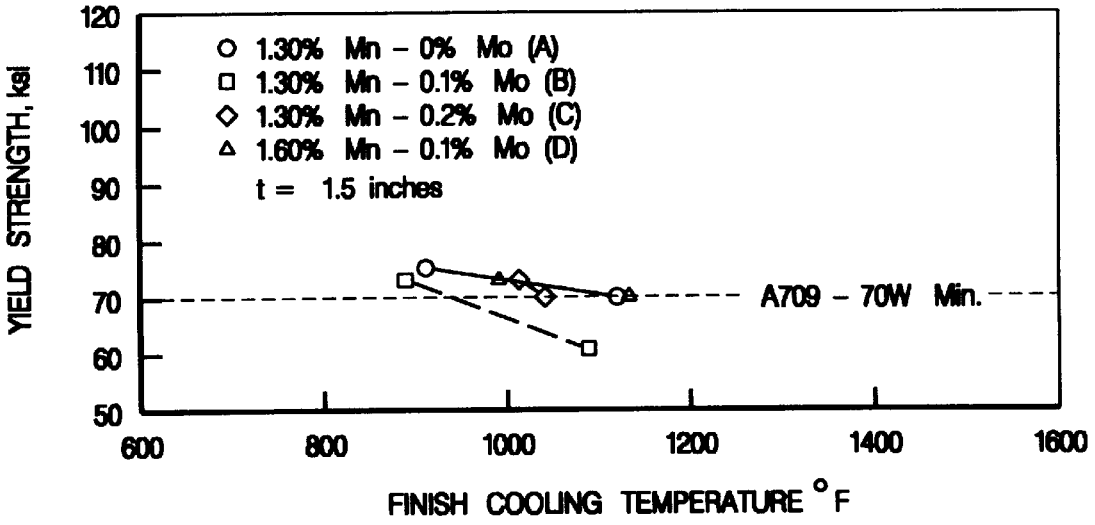
FIGS. 3A and 3B are graphs based on laboratory-derived data that depict the effects of manganese and molybdenum and finish cooling temperature on yield strength and tensile strength for 1.5" plates.
Figure 3B:
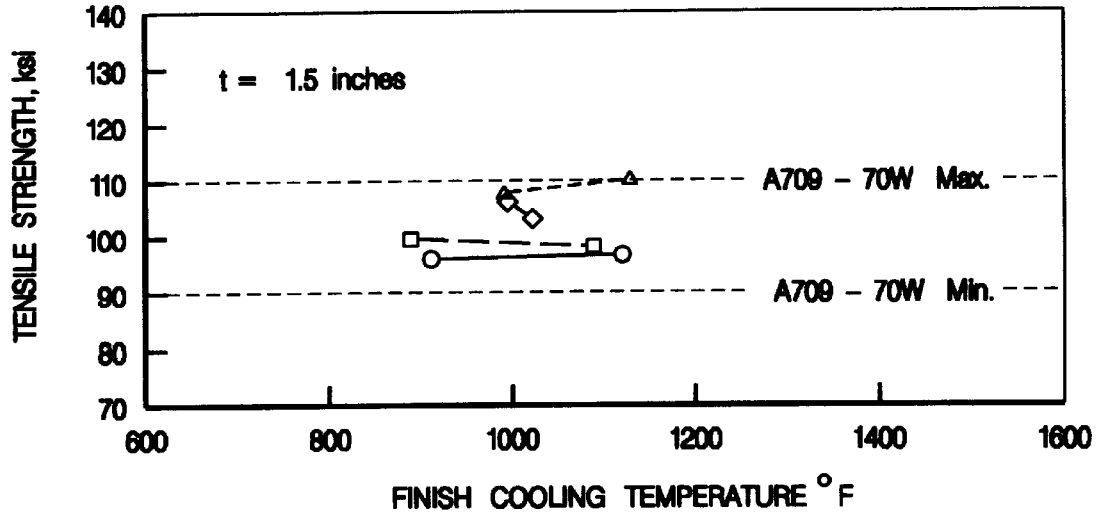

FIGS. 3A and 3B illustrate the effect of finish cooling temperature on yield strength and tensile strength for the different Alloys A–D. As in the is thinner gauge plate testing, FIG. 3A illustrates that too high of a finish cooling temperature will produce an insufficient yield strength. Again, a finish cooling temperature of less than about 1000° F., preferably around 900° F., should be used when processing the 1.30% Mn—0.10% Mo steel. Again, as in the thinner gauge plates, all four Alloys A–D exhibit a tensile strength of 90–110 KSI (FIG. 3B), and excellent CVN toughness at −10° F. (Table 6).

As noted above, increasing the amount of molybdenum increased the tensile strength for the 1.5" plates. A similar effect is seen when the manganese content increased from 1.30 to 1.60%.

For the 1.5 inch plates, the amount of bainite present increases with decreasing FCT for given steel. This is confirmed with the 1.30% Mn—0.10% Mo steel plate (Alloy B) when accelerated cooled to a FCT of 1080° F. The microstructure of this plate had more ferrite and, as such, had a low yield strength. However, when the FCT is decreased to 880° F., the amount of ferrite decreases significantly and the yield strength increases as a result of an increased amount of bainite present in the steel.

In summary, the 1.5" thick plates (Alloys A–D) all met the A709-70W requirements when accelerated cooled at about 9° F. per second to a FCT between 900 and 1050° F.

2.0 INCH THICK PLATES

Figure 4:
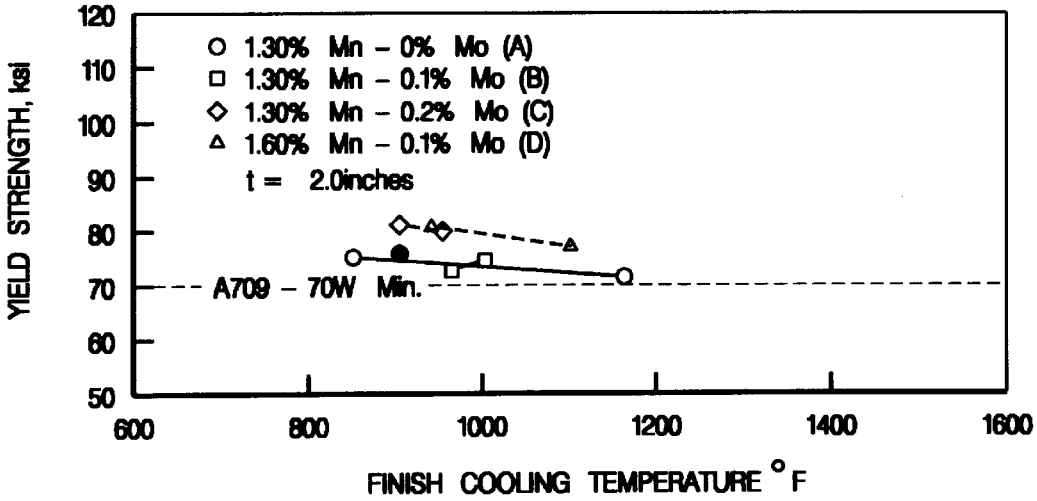
FIG. 4 is a graph based on laboratory-derived data that depicts the effects of manganese and molybdenum and finish cooling temperature on yield strength for 2.0" plates.

FIG. 4 illustrates the effect of finish cooling temperature and rolling practice on yield strength for Alloys A–D. The 2" plates were rolled with the practice of 1750° F./1550° F./55% and cooled at 6° F. per second. One of the 2" plates of the 1.30% Mn—0.10% Mo was also rolled with a more severe practice of 1650° F./1450° F./55% to assess the effect of rolling practice. As can be seen from FIG. 4, as the FCT is decreased from about 1150° F. to about 850° F., the yield strength of the steels increases slightly and meets the minimum 70 KSI requirement. For these FCTs, the tensile strength and CVN toughness of the steels remain relatively constant, and meet the A709-70W requirements (Table 6). Thus, all four steels meet the A709-70W requirements for a 2" thick plate in the accelerated cooled condition.

The change in rolling practice indicates that the more severe rolling practice, shown as a solid circle in FIG. 4, does not provide any positive effect on the mechanical properties of the steels tested.

The effects of manganese and molybdenum in the 2" thick plate are similar to that described above for the thinner gauge plates. That is, the increase in molybdenum results in a yield and tensile strength increase for the plate. In addition, the amounts of bainite increase with increasing molybdenum and manganese contents.

In summary, all four Alloys A–D met the A709-70W requirements for a plate thickness of 2.0" when accelerated cooled at about 7° F. per second to a FCT between about 900 and 1100° F.

3.0 INCH THICK PLATES

Figure 5A:
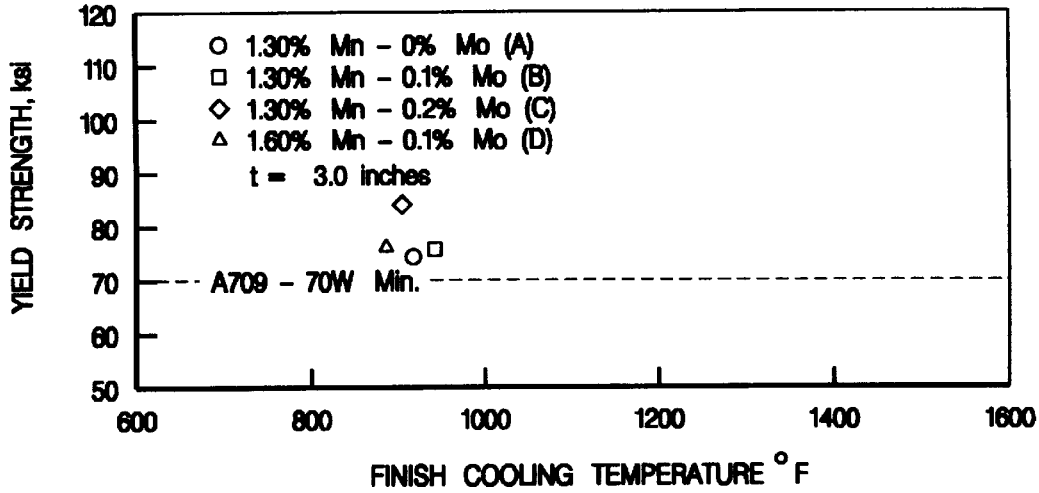
FIGS. 5A and 5B are graphs based on laboratory-derived data that depict the effects of manganese and molybdenum and finish cooling temperature on yield strength and toughness for 3.0" plates.
Figure 5B:
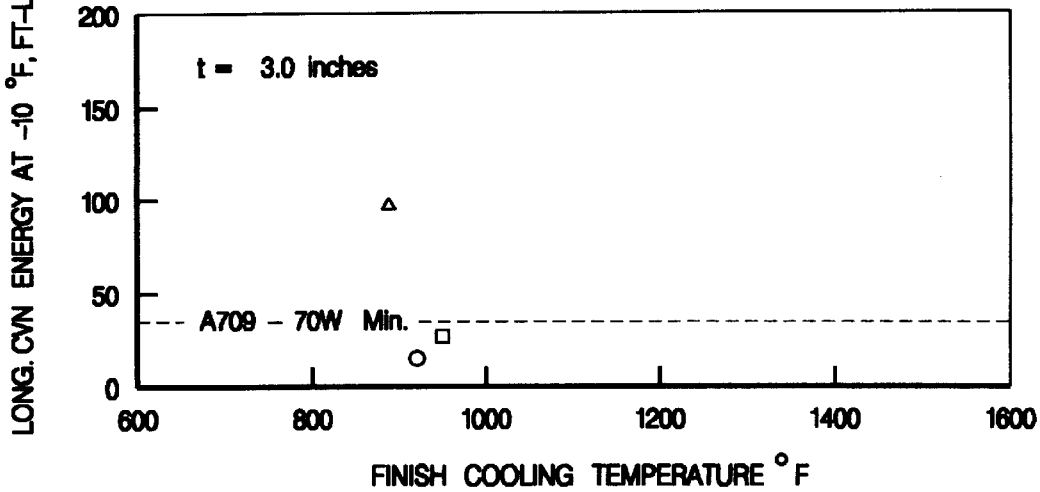

FIGS. 5A and 5B show the effect of finish cooling temperature on the yield strength and CVN toughness of Alloys A–D for 3" thick plates. FIG. 5A shows that all four steels achieve the minimum yield strength of 70 KSI at finish cooling temperatures of around 900° F. As shown in Table 6, all four steels exhibit a tensile strength within the required range of 90–110 KSI.

However, referring to FIG. 5B, the minimum CVN energy requirement was not met for steels containing only 1.30% manganese. However, the insufficient toughness can be related to the roughing and finish rolling practice. That is, the 3 inch plates were rolled from 6 inch thick slabs with a roughing practice of 2300° F./2000° F./17% and a finishing rolling practice of 1750° F./1600° F./40%. Accelerated cooling was conducted at 7° F. per second to a FCT of 900° F. The combination of only a 17% roughing reduction, along with only a 40% finishing reduction, is not enough hot working to produce grain refinement and good toughness that one can achieve through recrystallization and austenite flattening. However, the laboratory trials do indicate that the minimum yield strength of 70 KSI and the tensile strength range of 90–110 KSI can be met in the 3" thick plates with the tested alloy chemistries and cooling combinations. In other words, the reduction must be sufficient to achieve the requisite grain refinement in the final gauge plates product to achieve the 35 ft-lbs. at −10° F. toughness requirement of the A709-70W specification. It is anticipated that reductions of at least 50% below the intermediate temperature and roughing reductions greater than 20% should produce a 3" production plate meeting yield strength, tensile strength, and toughness requirements for A709-70W.

The laboratory trials clearly demonstrate a method for making a low-carbon, more castable, weldable and formable, high toughness weathering grade steel in an as-rolled and cooled condition. Using the inventive method, a plate product can be made to meet ASTM specifications in the as-rolled condition requiring a minimum of 70 KSI yield strength, 90–110 KSI tensile strength, and toughness greater than 35 ft-lbs. at −10° F. in plate as thick as 3.0 thick". The capability of making an as-rolled and cooled steel plate (no need for quenching and tempering to achieve strength and toughness levels) in plates within a range from about 0.5" up to about 4.0" thick is a significant advancement in weathering grade steels that must meet the ASTM A709 70W specification. The alloy chemistry coupled with controlled rolling and cooling provides a method of plate meeting the stringent compositional and mechanical property requirements of this specification.

As such, an invention has been disclosed in terms of preferred embodiments thereof which fulfills each and every one of the objects of the present invention as set forth above and provides a new and improved method of making an as-rolled and accelerated cooled weathering grade steel plate and a plate product therefrom having a minimum 70 KSI yield strength, a tensile strength of 90–110 KSI, and a Charpy V-notch toughness greater than 35 ft-lbs. at−10° F.

Of course, various changes, modifications and alterations from the teachings of the present invention may be contemplated by those skilled in the art without departing from the intended spirit and scope thereof. It is intended that the present invention only be limited by the terms of the appended claims.

TABLE 1

List of ASTM Specification for Weathering Bridge Applications

| ASTM Specification | Thickness Range | Processing* | Typical C level | Applications | Characteristics |
|---|---|---|---|---|---|
| A709 70W | ≦4" | HR/Q&T | 0.12% | Bridges | conventional Q&T, higher C steel |
| A709 HPS 70W | ≦4" | HR/Q&T | 0.09% | Bridges | New Q&T, low-C HPS grade |

*Hr/Q + T = Hot Rolled, austenitized, quenchcd and tempered.

TABLE 2

Mechanical Property Requirements of Weathering Bridge Steels

| ASTM Specification/ New Products | YS, ksi | TS, ksi | Elon. (in 2"), % | Longitudinal CVN Energy |
|---|---|---|---|---|
| A709 70W | ≧70 | 90–110 | 19 min | AASHTO Req.[1,2] |
| A709 HPS 70W | ≧70 | 90–110 | 19 min | AASHTO Req.[1,2] |

[1]AASHTO (American Association of State Highway and Transportation Officials) CVN toughness requirements for fracture-critical or fracture non-critical applications used in service temperature zones.
[2]The most stringent AASHTO requirement for 70W materials: fracture-critical impact test requirement for Zone 3 (minimum service temperature of −10° F. where a minimum of 35 ft-lbs is required).

TABLE 3

Compositional Ranges For Current ASTM Weathering Steel Grades

| Steel | | C | Mn | P | S | Si | Cu | Ni | Cr | Mo | V | Nb | Ti | Al | N |
|---|---|---|---|---|---|---|---|---|---|---|---|---|---|---|---|
| A709 70W | min | | 0.80 | | | 0.20 | 0.20 | | 0.40 | | 0.02 | | | | |
| (A852) | max | 0.19 | 1.35 | 0.035 | 0.04 | 0.65 | 0.40 | 0.50 | 0.70 | | 0.10 | | | | |
| A709 HPS 70W | min | | 1.15 | | | 0.35 | 0.28 | 0.28 | 0.50 | 0.04 | 0.05 | | | 0.01 | |
| | max | 0.11 | 1.30 | 0.020 | 0.006 | 0.45 | 0.38 | 0.38 | 0.60 | 0.08 | 0.07 | | | 0.04 | 0.015 |

TABLE 4

Compositions Of Weathering Steels According to Invention

| Steel | C | Mn | P | S | Si | Cu | Ni | Cr | Mo | V | Nb | Ti | Al | N |
|---|---|---|---|---|---|---|---|---|---|---|---|---|---|---|
| Alloy A | 0.076 | 1.28 | 0.016 | 0.005 | 0.40 | 0.29 | 0.30 | 0.50 | 0.00 | — | 0.063 | 0.011 | 0.032 | 0.0073 |
| Alloy B | 0.075 | 1.27 | 0.016 | 0.005 | 0.40 | 0.29 | 0.30 | 0.49 | 0.10 | — | 0.059 | 0.012 | 0.033 | 0.0074 |
| Alloy C | 0.069 | 1.28 | 0.016 | 0.006 | 0.40 | 0.28 | 0.31 | 0.49 | 0.20 | — | 0.061 | 0.012 | 0.031 | 0.0074 |
| Alloy D | 0.065 | 1.56 | 0.016 | 0.006 | 0.40 | 0.30 | 0.31 | 0.50 | 0.10 | — | 0.060 | 0.011 | 0.030 | 0.0075 |

TABLE 5

Plate Rolling Schedules for Alloys A–D

| | 0.5" plates (1780° F./1550° F./75%) | | 1.0" plates (1780° F./1550° F./60%) | | 1.5" plates (1750° F./1520° F./67%) | | 2.0" plates (1750° F./1550° F./55%) | | 3.0" plates (1750° F./1600° F./40%) | |
|---|---|---|---|---|---|---|---|---|---|---|
| Pass | Thickness, inches | Temp., ° F. | Thickness, inches | Temp., ° F. | Thickness, inches | Temp., ° F. | Thickness, inches | Temp., ° F. | Thickness, inches | Temp., ° F. |
| 0 | 4.00 | 2300 | 4.00 | 2300 | 6.00 | 2300 | 6.00 | 2300 | 6.00 | 2300 |
| 1 | 3.50 | 2150 | 3.50 | 2150 | 5.50 | 2100 | 5.50 | 2100 | 5.50 | 2100 |
| 2 | 3.00 | 2100 | 3.00 | 2100 | 5.00 | 2050 | 5.00 | 2050 | **5.00** | 2000 |
| 3 | 2.50 | 2050 | **2.50** | 2050 | **4.50** | 2000 | **4.50** | 2000 | 4.50 | **1750** |
| 4 | **2.00** | 2000 | 2.00 | **1780** | 4.00 | **1750** | 4.00 | **1750** | 4.00 | 1720 |
| 5 | 1.60 | **1780** | 1.60 | 1720 | 3.50 | 1720 | 3.50 | 1710 | 3.50 | 1670 |
| 6 | 1.30 | 1730 | 1.30 | 1650 | 3.00 | 1690 | 3.00 | 1670 | 3.10 | 1620 |
| 7 | 1.00 | 1680 | 1.05 | 1570 | 2.60 | 1660 | 2.60 | 1630 | 3.00 | 1600 |
| 8 | 0.75 | 1630 | 1.00 | 1550 | 2.20 | 1630 | 2.20 | 1580 | | |
| 9 | 0.55 | 1580 | | | 1.90 | 1600 | 2.00 | 1550 | | |
| 10 | 0.50 | 1550 | | | 1.70 | 1560 | | | | |
| 11 | | | | | 1.50 | 1520 | | | | |

The intermediate gages and temperatures are indicated in bold.

TABLE 6

Mechanical Properties of 0.5", 1.0", 1.5", 2.0", and 3.0" Plates of Alloys A–D

| Alloy | Gage, " | Rolling Practice IT/FRT/% RED | Cooling Practice SCT/FCT/CR* | 0.2% YS, ksi | TS, ksi | % Elong. (in 2") | % Red. of Area | Yield/Tensile Ratio | Long. CVN Energy @ −10° F., ft-lbs |
|---|---|---|---|---|---|---|---|---|---|
| A | 0.5 | 1780° F./1550° F./75% | 1460/1200/18 | 64.6 | 100.3 | 28 | 58.7 | 0.64 | 95, 111 |
| | | | 1460/1000/30 | 69.5 | 101.4 | 24 | 71.4 | 0.69 | 186, 142 |
| | 1.0 | 1780° F./1550° F./60% | air cooled | 60.1 | 83.4 | 28 | 65.6 | 0.72 | 178, 196 |
| | | | 1480/940/25 | 73.4 | 102.6 | 24 | 65.9 | 0.72 | 173, 163 |

TABLE 6-continued

Mechanical Properties of 0.5", 1.0", 1.5", 2.0", and 3.0" Plates of Alloys A–D

| Alloy | Gage, " | Rolling Practice IT/FRT/% RED | Cooling Practice SCT/FCT/CR* | 0.2% YS, ksi | TS, ksi | % Elong. (in 2") | % Red. of Area | Yield/Tensile Ratio | Long. CVN Energy @ −10° F., ft-lbs |
|---|---|---|---|---|---|---|---|---|---|
| | 1.5 | 1750° F./1520° F./67% | 1500/900/8 | 75.1 | 96.0 | 28 | 73.1 | 0.78 | 180, 189 |
| | | | 1500/1110/9 | 70.2 | 97.4 | 27 | 68.0 | 0.72 | 80, 121 |
| | | 1750° F./1550° F./55% | 1520/850/7 | 75.5 | 99.0 | 25 | 74.9 | 0.76 | 139, 68 |
| | 2.0 | | 1520/1160/5 | 70.7 | 99.3 | 26 | 68.9 | 0.71 | 111, 72 |
| | | 1650° F./1450° F./55% | 1430/900/10 | 75.8 | 99.0 | 27 | 72.0 | 0.77 | 105, 29 |
| | 3.0 | 1750° F./1600° F./40% | 1560/920/7 | 74.5 | 101.4 | 24 | 74.2 | 0.73 | 14, 18 |
| B | 0.5 | 1780° F./1550° F./75% | 1440/1080/14 | 73.9 | 105.1 | 28 | 68.2 | 0.70 | 162, 176 |
| | 1.0 | 1780° F./1550° F./60% | 1510/1060/9 | 73.7 | 109.8 | 23 | 67.8 | 0.67 | 97, 175 |
| | 1.5 | 1750° F./1520° F./67% | 1460/1080/12 | 60.9 | 98.4 | 24 | 57.8 | 0.62 | 61, 62 |
| | | | 1500/880/8 | 73.0 | 99.3 | 26 | 66.7 | 0.74 | 127, 146 |
| | 2.0 | 1750° F./1550° F./55% | 1530/1000/5 | 74.7 | 102.6 | 25 | 69.5 | 0.73 | 116, 131 |
| | | | 1520/960/6 | 72.0 | 101.7 | 25 | 68.9 | 0.71 | 113, 108 |
| | 3.0 | 1750° F./1600° F./40% | 1540/940/8 | 75.7 | 99.3 | 24 | 73.2 | 0.76 | 45, 12 |
| C | 0.5 | 1780° F./1550° F./75% | 1480/1130/10 | 67.8 | 105.6 | 26 | 66.7 | 0.64 | 181, 173 |
| | | | 1480/1000/29 | 67.8 | 109.1 | 28 | 62.0 | 0.62 | 155, 73 |
| | 1.0 | 1780° F./1550° F./60% | 1510/1030/20 | 67.4 | 104.2 | 23 | 66.4 | 0.65 | 134, 72 |
| | | | 1510/920/17 | 81.6 | 105.5 | 23 | 71.1 | 0.77 | 122, 118 |
| | 1.5 | 1750° F./1520° F./67% | 1480/1020/9 | 70.1 | 102.9 | 22 | 55.3 | 0.68 | 87, 124 |
| | | | 1500/1000/6 | 73.1 | 104.2 | 24 | 67.0 | 0.70 | 82, 73 |
| | 2.0 | 1750° F./1550° F./55% | 1520/900/6 | 82.8 | 104.2 | 27 | 73.4 | 0.79 | 164, 164 |
| | | | 1520/950/7 | 81.6 | 104.8 | 25 | 73.3 | 0.78 | 122, 138 |
| | 3.0 | 1750° F./1600° F./40% | 1560/920/8 | 83.2 | 105.9 | 22 | 74.6 | 0.79 | 12, 21 |
| D | 0.5 | 1780° F./1550° F./75% | 1460/1120/13 | 70.6 | 110.6 | 23 | 67.9 | 0.64 | 140, 159 |
| | 1 | 1780° F./1550° F./60% | 1510/1080/17 | 83.2 | 107.1 | 22 | 68.0 | 0.78 | 157, 100 |
| | 1.5 | 1750° F./1520° F./67% | 1500/980/8 | 73.6 | 107.7 | 24 | 66.2 | 0.68 | 177, 179 |
| | | | 1500/1120/8 | 70.4 | 110.2 | 22 | 58.9 | 0.64 | 86, 90 |
| | 2.0 | 1750° F./1550° F./55% | 1500/940/6 | 83.1 | 107.3 | 23 | 72.6 | 0.77 | 172, 146 |
| | | | 1520/1100/6 | 78.2 | 110.0 | 24 | 68.8 | 0.71 | 167, 134 |
| | 3.0 | 1750° F./1600° F./40% | 1560/900/7 | 76.6 | 103.4 | 24 | 69.3 | 0.74 | 82, 119 |

*Start Cooling Temperature, ° F./Finish Cooling Temperature, ° F./Cooling Rate, ° F./s

We claim:

1. A method of making an as-rolled and cooled weathering grade steel plate comprising:

providing a heated slab consisting essentially of, in weight percent, from about 0.05% to about 0.12% carbon;

from about 1.00% to about 1.80% manganase;

up to about 0.035% phosphorus;

up to about 0.040% sulfur;

from about 0.15% to about 0.65% silicon;

from about 0.20% to about 0.40% copper;

an amount of nickel up to about 0.50%;

from about 0.40% to about 0.70% chromium;

up to about 0.20% molybdenum;

from about 0.055% to about 0.09% niobium;

from about 0.005% to about 0.02% titanium;

an amount of aluminum up to 0.10%;

from about 0.001% to about 0.015% nitrogen;

with the balance iron and incidental impurities;

rough rolling the heated slab above the recrystallization stop temperature to an intermediate gauge plate;

finish rolling the intermediate gauge plate from an intermediate temperature below the recrystallization stop temperature to a finish rolling temperature above the $Ar_3$ temperature to produce a final gauge plate having a thickness up to about 4 inches; and subjecting the final gauge plate to at least liquid media accelerated cooling having a start cooling temperature above the $Ar_3$ temperature and a finishing cooling temperature below the $Ar_3$ temperature to form a weathering grade plate having a minimum of 70 KSI yield strength, 90–110 KSI tensile strength and a Charpy V-notch toughness greater than 35 ft-lbs. at −10° F.

2. The method of claim 1, wherein the manganese ranges between about 1.10% and 1.70%.

3. The method of claim 2, wherein the manganese ranges between about 1.20% and 1.40%.

4. The method of claim 1, wherein the niobium is up to about 0.08%.

5. The method of claim 4, wherein the niobium is up to about 0.07%.

6. The method of claim 1, wherein the molybdenum ranges between about 0.08% and 0.30%.

7. The method of claim 6, wherein the molybdenum ranges between about 0.08% and 0.12%.

8. The method of claim 1 wherein the manganese ranges between about 1.20% and 1.40%, the molybdenum ranges between about 0.08% and 0.20%, and the niobium ranges between about 0.055% and 0.07%.

9. The method of claim 1, wherein the accelerated cooling and the composition of the heated slab are controlled to produce continuous yielding in the cooled final gauge plate.

10. The method of claim 1, wherein a cooling rate for the accelerated cooling ranges between about 5 to 50° F./second.

11. The method of claim 10 wherein the cooling rate ranges between about 8 and 20° F./second for plates between about 0.5 inches and about 4.0 inches.

12. The method of claim 1, wherein the accelerated cooling finish cooling temperature ranges between about 850° F. and 1300° F.

13. The method of claim 12, wherein the finish cooling temperature ranges between about 900° F. and 1050° F.

14. The method of claim 1, wherein the start cooling temperature ranges from about 1350° F. to about 1600° F.

15. The method of claim 14, wherein the start cooling temperature ranges from about 1500° F. to about 1600° F.

16. The method of claim 1, wherein the finish rolling temperature ranges from about 1400° F. to about 1650° F.

17. The method of claim 16, wherein the finish rolling temperature ranges from about 1450° F. to about 1600° F.

18. An as-rolled and cooled weathering grade steel plate made by the method of claim 1, the plate having a plate thickness of at least 0.5 inches, a minimum of 70 KSI yield strength, and a tensile strength of 90–110 KSI.

19. The as-rolled and cooled weathering grade steel plate of claim 18, wherein the plate has a plate thickness greater or equal to 2 inches.

20. The as-rolled and cooled weathering grade steel plate of claim 18, wherein the plate has a toughness measured by Charpy V-notch testing of greater than 35 ft-lbs. at −10° F.

21. The method of claim 1, wherein a slab thickness provides sufficient rolling reduction percentage for a 2.5 to 4.0 inch final gauge plate product to achieve a toughness in the plate as measured by Charpy V-notch testing of greater than 35 ft-lbs. at −10° F.

22. The method of claim 21, wherein a slab thickness ranges between about 8 and 16 inches.

23. A weathering grade steel composition consisting essentially of, in weight percent:

from about 0.05% to about 0.12% carbon;

from about 1.00% to about 1.80% manganese;

up to about 0.035% phosphorus;

up to about 0.040% sulfur;

from about 0.015% to about 0.65% silicon;

from about 0.20% to about 0.40% copper;

an amount of nickel up to about 0.50%;

from about 0.40% to about 0.70% chromium;

up to about 0.20% molybdenum;

from about 0.055% to about 0.09% niobium;

from about 0.005% to about 0.02% titanium;

an amount of aluminum up to 0.10%;

from about 0.001% to about 0.015% nitrogen; with the balance iron and incidental impurities.

24. The composition of claim 23, wherein carbon ranges between about 0.07 and 0.09%, manganese ranges between about 1.25 and 1.35%, titanium ranges between about 0.008 and 0.014%, niobium ranges between about 0.055 and 0.070%, and molybdenum ranges between about 0.09 and 0.11%.

25. The plate of claim 18, wherein the niobium is up to 0.08%.

26. The plate of claim 25, wherein the niobium is up to 0.070%.

27. An as-rolled and cooled weathering grade steel plate having the composition of the steel of claim 23, the plate having a plate thickness of at least 0.5 inches, a minimum of 70 KSI yield strength, and a tensile strength of 90–110 KSI.

28. The as-rolled and cooled weathering grade steel plate of claim 26, wherein the plate has a plate thickness greater or equal to 2 inches.

29. The as-rolled and cooled weathering grade steel plate of claim 26, wherein the plate has a toughness measured by Charpy V-notch testing of greater than 35 ft-lbs. at −10° F.

* * * * *